US011017184B2

(12) United States Patent
Tsividis et al.

(10) Patent No.: US 11,017,184 B2
(45) Date of Patent: May 25, 2021

(54) RUNTIME-CALIBRATABLE ANALOG COMPUTING SYSTEM AND METHODS OF USE

(71) Applicant: Sendyne Corporation, New York, NY (US)

(72) Inventors: Yannis Tsividis, New York, NY (US); Carl Oppedahl, Summit County, CO (US)

(73) Assignee: Sendyne Corporation, New York, NY (US)

( * ) Notice: Subject to any disclaimer, the term of this patent is extended or adjusted under 35 U.S.C. 154(b) by 0 days.

(21) Appl. No.: 16/642,354

(22) PCT Filed: Oct. 16, 2019

(86) PCT No.: PCT/IB2019/058816
§ 371 (c)(1),
(2) Date: Feb. 26, 2020

(87) PCT Pub. No.: WO2020/084401
PCT Pub. Date: Apr. 30, 2020

(65) Prior Publication Data

US 2021/0073483 A1 Mar. 11, 2021

Related U.S. Application Data

(60) Provisional application No. 62/704,027, filed on Oct. 26, 2018, provisional application No. 62/704,067,
(Continued)

(51) Int. Cl.
*G06G 7/66* (2006.01)

(52) U.S. Cl.
CPC ..... *G06G 7/66* (2013.01)

(58) Field of Classification Search
CPC ..... G06G 7/66
(Continued)

(56) References Cited

U.S. PATENT DOCUMENTS 3,898,625 A * 8/1975 Lamden ..... G06G 7/66 708/1
4,035,619 A * 7/1977 Cholet ..... F02P 5/1556 701/101

(Continued)

FOREIGN PATENT DOCUMENTS

CN 104158543 A 11/2014
WO WO2011152896 A1 12/2011

OTHER PUBLICATIONS

Huang et al ("Analog Computing in a Modern Context: A Linear Algebra Accelerator Case Study", IEEE, 2017, pp. 30-38) (Year: 2017).*

(Continued)

*Primary Examiner* — Iftekhar A Khan
(74) *Attorney, Agent, or Firm* — Oppedahl Patent Law Firm LLC

(57) ABSTRACT

The inventive disclosures described herein generally pertain to an improved runtime-calibratable analog-computing system. In many embodiments, the improved analog-computing system comprises at least two analog computers, wherein after initial calibration, the system is designed to stagger the runtime calibration modes of each of the at least two analog-computers such that at least one of the analog computers is always in service, thus preventing any downtime for the overall system. In other words, a system user sees one initial calibration, and computing by the overall system is never interrupted.

17 Claims, 7 Drawing Sheets

Related U.S. Application Data filed on Oct. 7, 2019, provisional application No. 62/911,842, filed on Oct. 7, 2019.

(58) Field of Classification Search
USPC ..... 703/8
See application file for complete search history.

(56) References Cited

U.S. PATENT DOCUMENTS 4,494,068 A * 1/1985 Ley ..... G01R 1/203 324/126
4,509,019 A * 4/1985 Banu ..... H03H 11/1291 330/107
4,682,102 A * 7/1987 Milkovic ..... G01R 21/127 324/107
4,823,026 A * 4/1989 Hanson ..... G01R 19/0053 327/186
5,541,600 A 7/1996 Blumenkrantz et al.
5,734,596 A 3/1998 Hallberg
6,104,968 A * 8/2000 Ananth ..... G06F 7/602 323/283
6,963,603 B1 * 11/2005 Rezvani ..... H04B 3/56 370/206
7,436,251 B2 * 10/2008 Ozgun ..... H03F 3/45475 327/561
7,622,820 B1 * 11/2009 Prodic ..... H02M 3/158 307/31
8,165,309 B2 * 4/2012 Gustaffsson ..... G10H 1/16 381/61
8,350,552 B1 * 1/2013 Marten ..... G01K 7/01 323/297
8,493,141 B2 * 7/2013 Khlat ..... H03F 3/189 330/127
9,054,723 B2 6/2015 Oshima et al.
9,171,189 B2 * 10/2015 Tsividis ..... G06G 7/1865
9,866,227 B1 * 1/2018 Bresciani ..... H03M 1/46
2004/0229562 A1 * 11/2004 Wren ..... H04L 27/02 455/3.02
2004/0258176 A1 * 12/2004 Mattsson ..... H03F 1/3247 375/297
2006/0214737 A1 * 9/2006 Brown ..... H03L 7/10 331/16
2007/0064923 A1 * 3/2007 Schmukler ..... H03H 11/265 379/406.1
2009/0135033 A1 * 5/2009 Huppertz ..... H03M 3/384 341/118
2009/0259709 A1 * 10/2009 Nikitin ..... G06G 7/02 708/801
2010/0321115 A1 * 12/2010 Mohajeri ..... H03F 3/21 330/297
2012/0075132 A1 * 3/2012 Lai ..... H03M 3/38 341/143
2012/0293233 A1 * 11/2012 Gupta ..... H03F 1/223 327/339
2013/0027097 A1 * 1/2013 Wang ..... H03L 7/0891 327/156
2013/0222164 A1 * 8/2013 Shiozaki ..... H03H 15/00 341/122
2014/0139280 A1 * 5/2014 Tsividis ..... H03K 5/14 327/261
2014/0324936 A1 * 10/2014 Alexander ..... G06F 17/10 708/404
2014/0354343 A1 12/2014 Carscadden
2015/0066438 A1 * 3/2015 Brooks ..... H03K 3/0231 702/191
2016/0238998 A1 * 8/2016 Pavlovic ..... H03C 3/0941
2016/0373120 A1 * 12/2016 Caffee ..... H03L 7/0814
2017/0012631 A1 * 1/2017 Dato ..... H03L 7/0992
2019/0212703 A1 * 7/2019 Yao ..... H03L 7/0891

OTHER PUBLICATIONS

Guo et. al ("Energy-Efficient Hybrid Analog/Digital Approximate Computation in Continuous Time", IEEE, 2016, pp. 1514-1524) (Year: 2016).*
Bendtsen J D et al. Bumpless transfer between observer-based gain scheduled controllers, International Journal of Control, vol. 78, No. 7, Sep. 2, 2006, pp. 491-504.
PCT International Search Report of the European Patent Office in PCT/IB2019/058816 dated Jan. 16, 2020.
PCT Written Opinion of the European Patent Office in PCT/IB2019/058816 dated Jan. 16, 2020.
PCT International Search Report of the Japanese Patent Office in PCT/IB2019/058816 dated Jan. 10, 2020.
PCT Written Opinion of the Japanese Patent Office in PCT/IB2019/058816 dated Jan. 10, 2020.
PCT International Search Report of the Chinese patent office in PCT/IB2019/058816 dated Jan. 10, 2020.
Peer Contribution Form of the USPTO in PCT/IB2019/058816 dated Jan. 6, 2020.
Kai Zheng et al, "Steady-state bumpless transfer under controller uncertainty using the state/output feedback topology", 43rd IEEE Conf on Decision and Control, Dec. 14, 2004.
Tsividis Y., "Self-Tuned Filters", Electronics Letters, vol. 17, No. 12, Jun. 11, 1981.
International Search Report in PCT/IB2019/058816 dated Feb. 25, 2020.
Written Opinion in PCT/IB2019/058816 dated Feb. 25, 2020.

* cited by examiner

RUNTIME-CALIBRATABLE ANALOG COMPUTING SYSTEM AND METHODS OF USE

CROSS-REFERENCE TO RELATED APPLICATIONS

This hereby incorporates by reference U.S. Patent Application No. 62/704,027 filed Oct. 26, 2018, and U.S. Patent Application No. 62/704,067 filed Oct. 7, 2019, and U.S. Patent Application No. 62/911,842 filed Oct. 7, 2019 for all purposes. Should any irreconcilable conflicts arise between this patent application and just-mentioned earlier patent applications for purposes of claim construction or interpretation, then this patent application's teachings shall govern.

BACKGROUND

This patent application directs itself to physical analog computers. By this we mean computers that carry out computations by means of analog electrical circuitry that manipulates analog electrical signals, typically for the purpose of solving differential equations. Importantly, such computers are better suited in many ways than are digital computers for solving nonlinear differential equations. There was a time before digital computers became popular that analog computers were widely used for computation. When digital computers became popular, only a much smaller fraction of computation took place by means of analog computation. But in very recent times, perceptive investigators have come to appreciate that for certain types of real-life situations, it can be very helpful to make use of analog computation, often in a computational system that includes both a digital computer and an analog computer. This has, in very recent times, prompted perceptive investigators to try to think of ways to do analog computation better or faster or less expensively or in a smaller form factor or with greater dynamic range or with better bandwidth or with the ability to handle more complex mathematical computations. For tasks such as solution of a system of differential equations, the analog computation desirably consumes much less computational energy as compared with legacy digital computational approaches.

Such hybrid computation has proven to be particularly powerful for at least two categories of work: sophisticated simulation of systems, and sophisticated control and management of real-life systems.

A hasty reader might assume that what is being discussed is a digital simulation of analog circuitry, or a digital simulation of analog phenomena. Such is not the present discussion. What is being discussed is actual analog circuitry, such as integrators and amplifiers and other elements that make up analog computers, working alongside a digital computer. The challenges being described and, hopefully, solved are physical challenges of physical electrical voltages and currents, not mental steps.

Many analog computers in the past were made using expensive components, whose values remained within relatively narrow tolerances even in the presence of temperature changes and aging. This made such analog computers expensive. Some modern-day analog computer applications call for the designer to try to make the computer less expensive, and this may call for use of less expensive components. The decision to use less expensive components likely leads to a need for more frequent calibration and re-calibration so as to compensate for the effects of temperature changes (ambient and system) during operations.

During such time as an analog computer is being calibrated it cannot, of course, be carrying out production calculations. In some applications (for example a student educational environment) it might not be a problem that sometimes the analog computer is not available for actual calculations. But in recent times some applications for analog computation, as mentioned above, are for modeling and control of real-life production systems. In such applications it is desired and indeed substantially necessary that the analog computation be carried out in an uninterrupted (continuous) fashion for long periods of time. If an analog computer were to be taken out of production service to permit recalibration, and if the consequence were an interruption in the ability to carry out the modeling or control of the real-life system, this would be a big problem. This is so because the need for such calibration operations interrupts overall system service. The magnitude of the problem is all the greater if the production system has humans in the loop.

The experienced user of analog computers will also appreciate that each time the analog computer is calibrated, it needs some time for transients to settle after the analog computer is reconnected to its inputs so as to be placed back into production service.

The aforementioned issues especially present themselves in many real-world applications, where downtime of a key analog-computing system may be highly detrimental to key systems within power plants, refineries, and other real-world applications.

To recap the overall challenge, what may be said is that some physical analog computers are used in a production environment, meaning that we want to carry out the analog computations more or less continuously. This lies in conflict with the fact that it is necessary to carry out calibration of particular elements of the analog computer from time to time. The need for calibration (or recalibration) might be due for example to localized temperature changes in a substrate. To carry out calibration, it is necessary to disconnect the analog computer from the production inputs of the system to which it would normally be connected during production service, and to connect it instead to calibration inputs. At such time the outputs of the analog computer, which in production service would be connected to production outputs of the system, would need to be connected to calibration connections.

What is needed is an improved analog-computing scheme that is initially calibrated and then during runtime, can be recalibrated as necessary, and yet somehow accomplishing the recalibration in a way that avoids interruption of the overall system operations.

BRIEF SUMMARY

The inventive disclosures described herein generally pertain to an improved runtime-calibratable analog-computing system. In many embodiments, the improved analog-computing system comprises at least two analog computers, wherein after initial calibration, the system is designed to stagger the runtime calibration modes of each of the at least two analog-computers such that at least one of the analog computers is always in service, thus preventing any downtime for the overall system. In other words, a system user sees one initial calibration, and computing by the overall system is never interrupted.

The foregoing Brief Summary is intended to merely provide a short, general overview of the inventive disclosure described throughout this patent application, and therefore, is not intended to limit the scope of the inventive disclosure contained throughout the balance of this patent application, including any appended claims and drawings.

BRIEF DESCRIPTION OF THE DRAWINGS

In FIG. 3A, Computer-1 is in service while Computer-2 is in a calibration mode. In FIG. 3B, Computer-1 is still in service; however, Computer-2 is transitioning out of calibration mode by connecting it to the input (thus, the input of Computer-2 is no longer received from the calibration module); however, the output switch for Computer-2 is still positioned to be connected to the calibration module and not connected to the overall system output in order to give Computer2 time for transients (e.g., "hunting") to dissipate. FIG. 3C shows the next phase of the system transition, in that Computer-2 is now connected to the overall system output (that is, placed in service), which places the operations of Computer-1 and Computer-2 in parallel with each other for a brief period of time. Next, as shown in FIG. 3D, Computer-1 is placed in calibration mode, which removes Computer-1 from the overall system output.

In FIG. 5A, the state-information transfer occurs via a direct transfer of analog data. In FIG. 5B, the state-information transfer occurs via the use of intermediary onboard analog-data processing components, such as analog-to-digital converters (ADCs), random-access memory (RAM), and digital-to-analog converters (DACs).

DETAILED DESCRIPTION

[1] Overview

The inventive disclosures described herein generally pertain to an improved runtime-calibratable analog-computing system. In many embodiments, the improved analog-computing system comprises at least two analog computers, wherein after initial calibration, the system is designed to stagger the runtime calibration modes of each of the at least two analog-computers such that at least one of the analog computers is always in service, thus preventing any downtime for the overall system. In other words, a system user sees one initial calibration, and computing by the overall system is never interrupted.

[2] An Improved Runtime-Calibratable Analog-Computing System

This Section II is directed generally to an improved runtime-calibratable analog-computing system. Refer to FIGS. 1A through 6C.

[1] Achieving Transparent Runtime Calibration of an Analog-Computing System

Figure 1A:
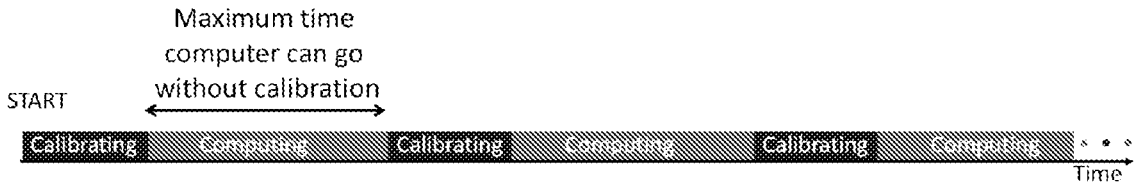
FIG. 1A depicts a typical output versus time profile of a prior-art analog-computing system that has to follow a conventional calibration process.
Figure 1B:
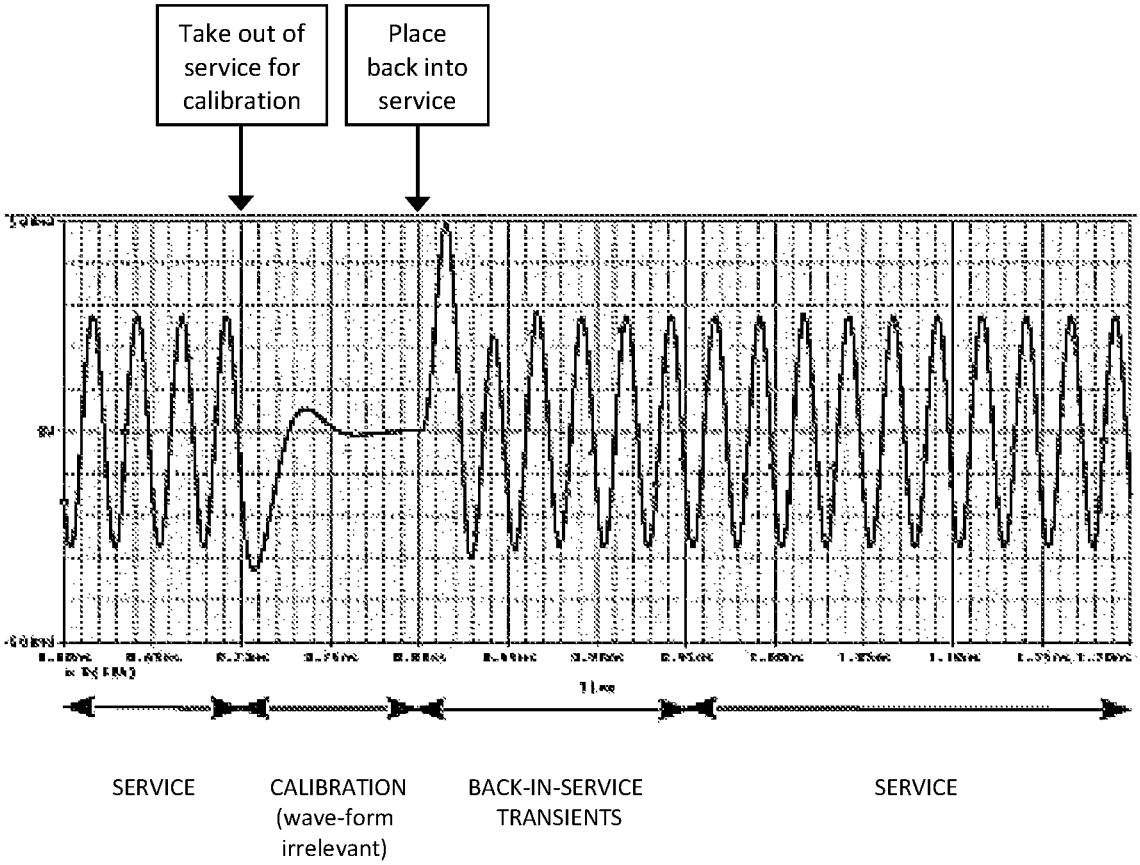
FIG. 1B depicts a simplified timeline for a prior-art analog-computing system that illustrates the ongoing issue with maintaining the calibration of such a system; that is, the system must be periodically taken offline for calibration.
Figure 1C:
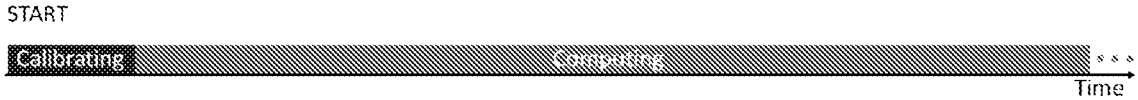
FIG. 1C depicts one embodiment of a simplified timeline illustration of the calibration of an improved analog-computing system; that is, the improved analog-computing system, as perceived by an external user, requiring (or appearing to to the external user to require) only an initial calibration of the analog-computing system before it comes online, and then maintaining its calibrated status thereafter without (from the point of view of the external user) having to go out of service.

In the prior art, to maintain the proper calibration of an analog-computing system, the system must be taken out of service, calibrated, then placed back in service. The experienced user appreciates that even the placing back into service is not instant, because there is some lag time before the system is back to optimum performance due to system transients as it comes back on line. See FIG. 1A, which depicts the typical output versus time profile of a prior-art analog-computing system that has to follow this calibration process. FIG. 1B depicts a simplified timeline for a prior-art analog-computing system that illustrates the ongoing issue with maintaining the calibration of such a system; that is, the system must be periodically taken offline for calibration. The general goal of the preset improved analog-computing system is to create an analog-computing system that, from a standpoint, of an external point of view, requires (or appears from the external point of view to require) only an initial calibration of the analog-computing system before it comes online, and then maintains its calibrated status thereafter without having to go out of service, as depicted in the simplified timeline illustration in FIG. 1C.

Figure 2A:
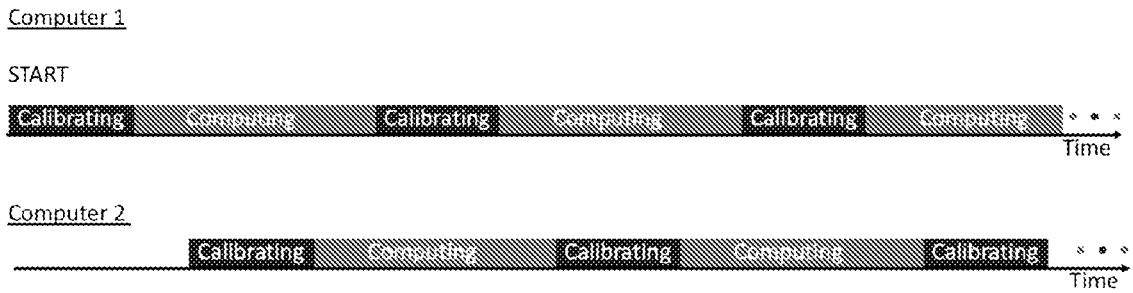
FIG. 2A depicts a simplified timeline illustration of an improved analog-computing system that is comprised of two analog computers, such that while the first analog computer is computing, the second one is calibrating, and vice-versa. Notably, there is an overlap between the two "computing" blocks so as to avoid any interruption in actual in-service operations of the overall system.
Figure 2B:
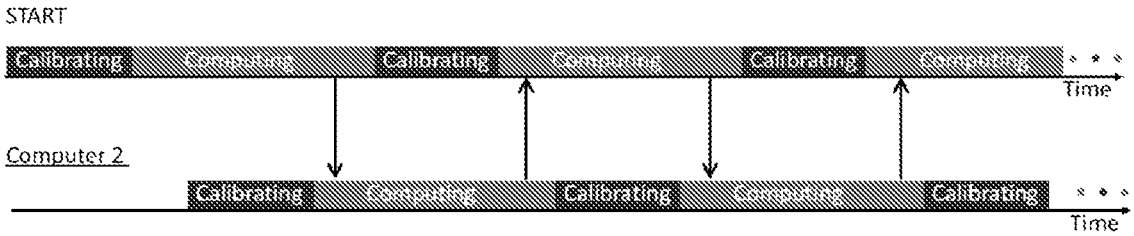
FIG. 2B depicts the simplified timeline illustration of an improved analog-computing system from FIG. 2A, except that in this embodiment the system uses a smooth "handoff" of system state information while the two separate onboard analog computers swap modes between being in service and being in calibration. It is important to ensure that the "handoff" occurs without causing transients in the overall analog-computing system.
Figure 2C:
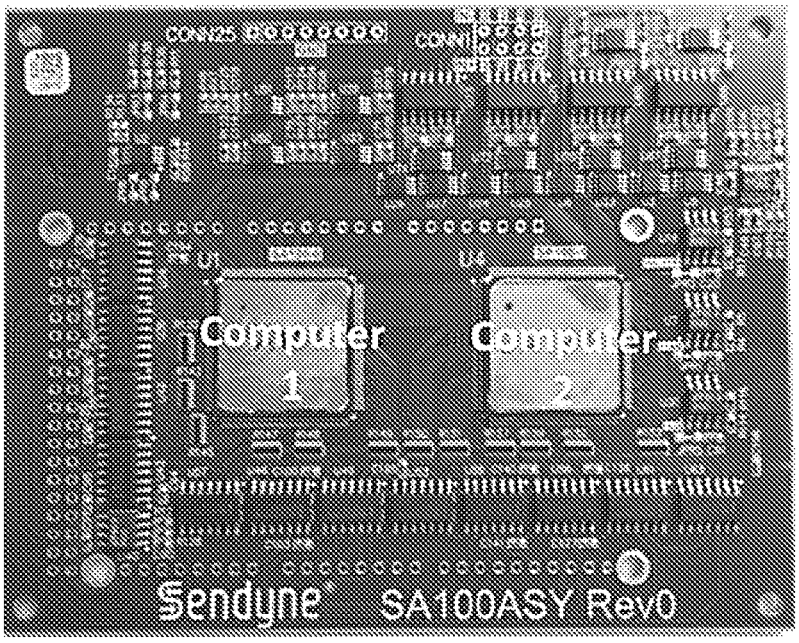
FIG. 2C depicts one example of a physical embodiment of an actual two-analog-computer board that implements the calibration schema of FIGS. 2A and 2B.

In one embodiment, two analog computers (or two sub-analog-computers on the same chip) are used. Referring to FIG. 2A, while the first analog computer is computing, the second one is calibrating, and vice-versa. Notably, there is an overlap between the two "computing" blocks so as to avoid any interruption in actual in-service operations of the overall system. Using a smooth "handoff" (see FIG. 2B) of system state information, the two separate analog computers swap modes between being in service and being in calibration. In variations, the "handoff" occurs from one analog computer to another. However, it is important to ensure that the "handoff" occurs without causing transients in the system. One solution is to adopt a long-established technique for filter tuning, as described in Y. Tsividis, "Self-tuned filters," Electronics Letters, vol. 17, no. 12, pp. 406-407, 11 Jun. 1981, the teachings of which are incorporated herein by reference. FIG. 2C depicts one example of an actual two-analog-computer board that implements this calibration schema.

The alert reader will be aware that there are several ways to accomplish the computation that uses two or more analog computers as described herein, in coordination with digital computer resources. FIG. 2C shows a circuit board with two analog computers shown as Computer 1 and Computer 2. Each computer, for example Computer 1, has integrators, function generators, multipliers, adders, inverters, and other circuit elements that help to make up an electronic analog computer. In and around these circuit elements is an analog switching fabric that is controlled from outside the analog computer. This switching fabric serves a function closely analogous to the "plug board" which was used many decades ago with legacy analog computers. The switching fabric will remind the alert reader of the connections that come into existence during the configuration of a field programmable gate array (FPGA) in present-day digital technology. The analog switching fabric of the analog computer such as Computer 1 is controlled by digital computing resources that are external to the analog computer.

The alert reader will further appreciate that if the number of circuit elements in the analog computer named Computer 1 is sufficiently large, then for a given set of differential equations that is to be solved, it may be possible to "construct" two analog computers within Computer 1, each of which is composed of whatever circuit elements are needed to carry out the desired computation. The two analog computers would then be contained within a single chip appearing to the human observer to be Computer 1. This gives rise to the notion of two sub-analog-computers on the same chip.

The teachings of the present invention offer their benefits regardless of whether the two computers that are linked up (with one being calibrated while the other is carrying out the externally observed computations) are on the one hand visible to a human user as separate chips, or are merely distinct analog computers constructed by means of suitable configuration of switching fabric and circuit elements all within a single chip.

See FIGS. 3A through 3D, which collectively illustrate one embodiment of a simplified example of the runtime-calibration scheme for an improved analog-computing system 1. Assume that an "input" 40 and an "output" 45 are present. It will be appreciated that in real-life situations these values are likely to be vector values. Saying this differently, each of the switches for example 5 and 10 and 15 and 20 is a multiple-pole switch. For simplicity of portrayal in the figures, and to make the textual discussion easy to follow, we will speak as if there were a single line of input and a single line of output, and that each of switches for example 5 and 10 and 15 and 20 is a single-pole switch. But again it is emphasized that the more general case is that there are vector values switched by multiplex switches. It will thus be convenient in discussions below of apparatus to refer in a general way to "switching fabric" that brings about the (likely multiplex) switching at for example 5 and 10 and 15 and 20.

Figure 3A:
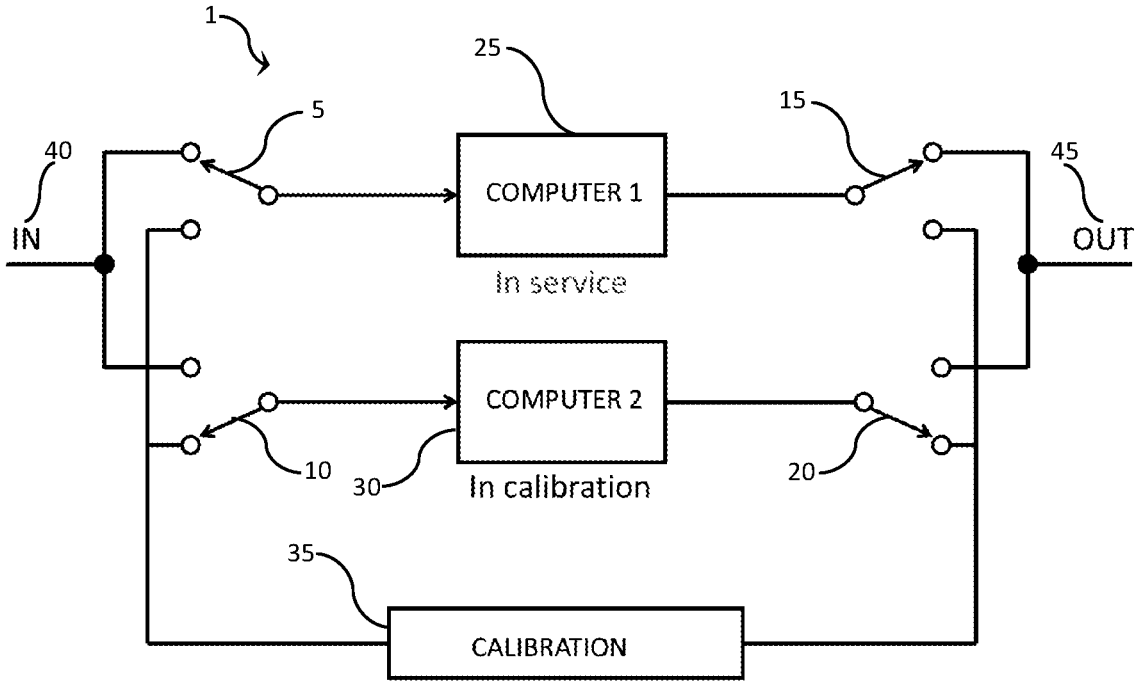
FIGS. 3A through 3D collectively illustrate one embodiment of a simplified example of the runtime-calibration scheme for an improved analog-computing system.
Figure 3B:
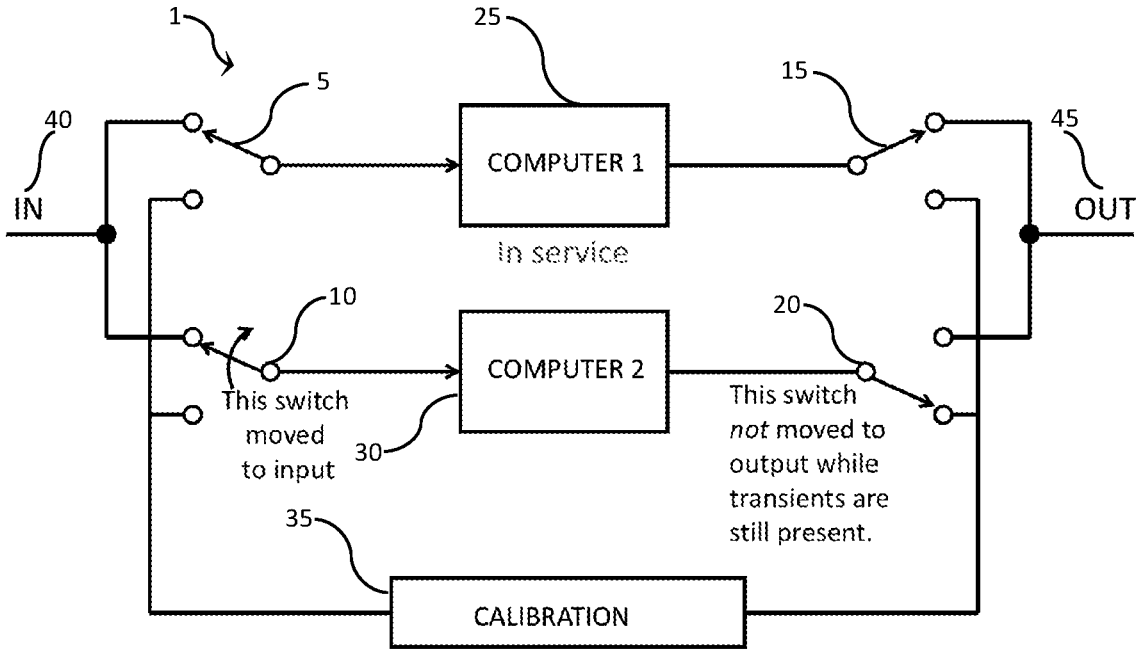
Figure 3C:
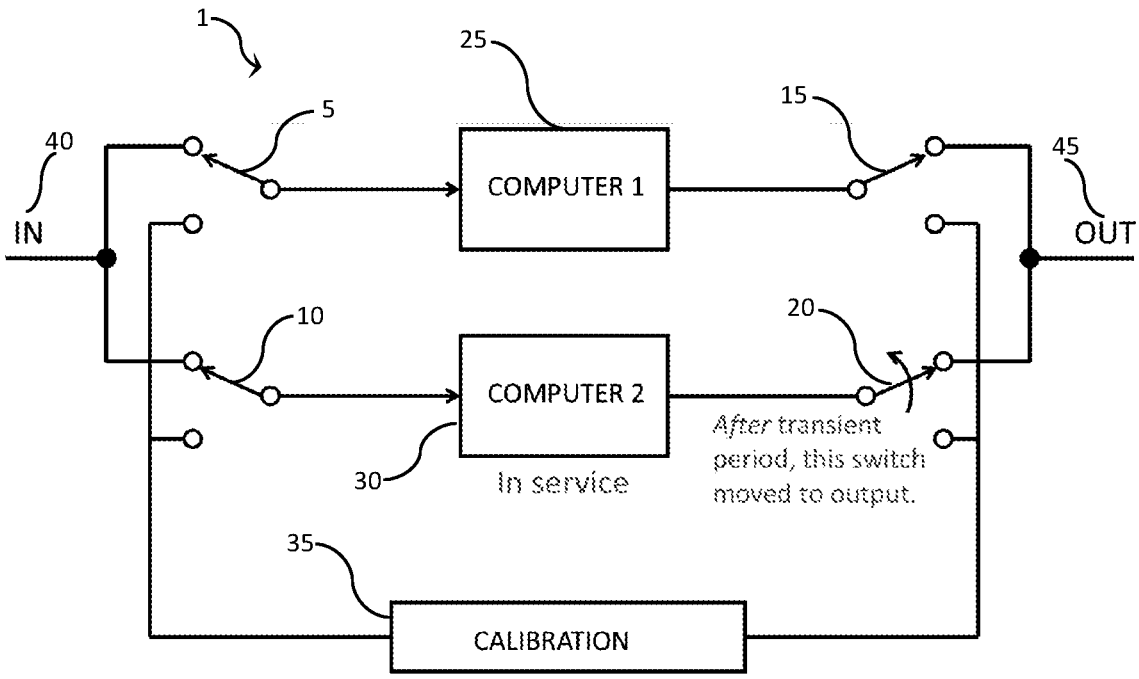
Figure 3D:
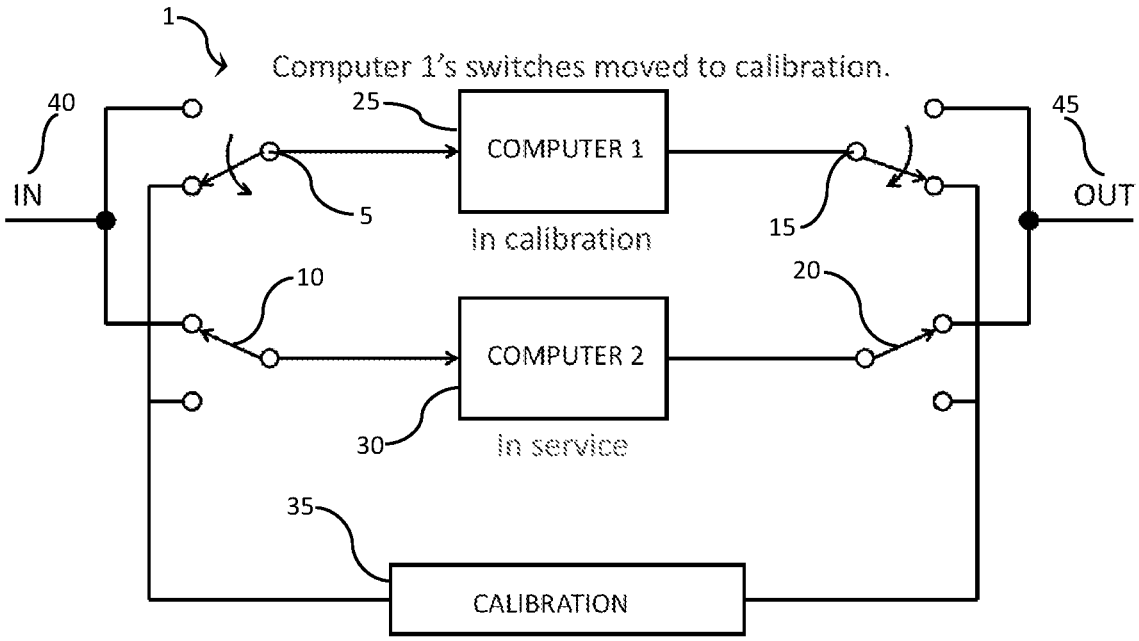

In FIG. 3A, Computer-1 25 is in service (by which we mean "production service"), based on the positions of input switch 5 and output switch 15, while Computer-2 30 is in a calibration mode and in communication with a calibration module 35 via the positions of input switch 10 and output switch 20. In FIG. 3B, Computer-1 25 is still in service, based on the positions of input switch 5 and output switch 15; however, Computer-2 30 is transitioning out of calibration mode by connecting it to the input 40 via input switch 10 (thus, the input of Computer-2 30 is no longer received from the calibration module 35); however, the output switch 20 is still positioned to be connected to the calibration module 35 and not connected to the output 45 in order to give Computer2 30 time for transients (e.g., "hunting") to dissipate, after which the output of Computer-2 30 can be used for the system output 45. In typical variations, the calibration module 35 comprises a test suite of test signals/input values to be processed through the connected analog computer undergoing calibration, an associated set of predicted output values to compare with the output of the analog computer undergoing calibration, and a means to adjust the calibration settings of the analog computer. FIG. 3C shows the next phase of the system transition, in that Computer-2 30 is now connected to the system output 45 (that is, placed in service) via output switch 20, which places the operations of Computer-1 25 and Computer-2 30 in parallel with each other for a brief period of time. Next, as shown in FIG. 3D, Computer-1 25 is placed in calibration mode 35 via input switch 5 and output switch 15.

It should be understood by the alert reader that in some preferred embodiments, some of the aforementioned switches 5, 10, 15, 20 should be of a "make-before-break" type to ensure that the transition between analog computers as one reenters its service mode and the other enters the calibration mode does not result in a dropped/lost signal (input or output). Others might be a "break before make" type as will be discussed below.

In more variations, the improved analog-computing system 1 includes a means to compare the outputs of the two analog computers 25, 30 to determine whether the analog computer 25, 30 outputs are within a predetermined differential with respect to each other in order to avoid a sudden and undesired system transient as a result of the swap of the in-service analog computers 25, 30. If the output differential between the oncoming analog computer 25, 30 exceeds some predetermined threshold, then in some embodiments, a means to provide a system alert/annunciation is provided for end users, and/or the handoff/transfer between the analog computers 25, 30 may be suspended to allow for end-user troubleshooting. The overall system 1 is configured to swap the operational modes of Computer-1 25 and Computer-2 30, back and forth, in a similar manner in order to maintain overall system 1 calibration while eliminating any externally observed downtime of system 1.

In other variations, more than two analog computers 25, 30 can be used for such swapping between service and calibration modes in order to increase overall system 1 reliability for especially high-risk practical applications. The aforementioned output-comparison means during the transition of in-service analog computers 25, 30, in which there are three or more analog computers involved, can be subjected to a coincidence-logic or "voting" system whereby if the output values for the majority of the analog computers are within a predetermined threshold of each other, then that majority value (which in variations can be an average of the majority values) will control whether or not to allow an analog computer that has been in calibration mode to come online and take-over the system operations.

Figure 4A:
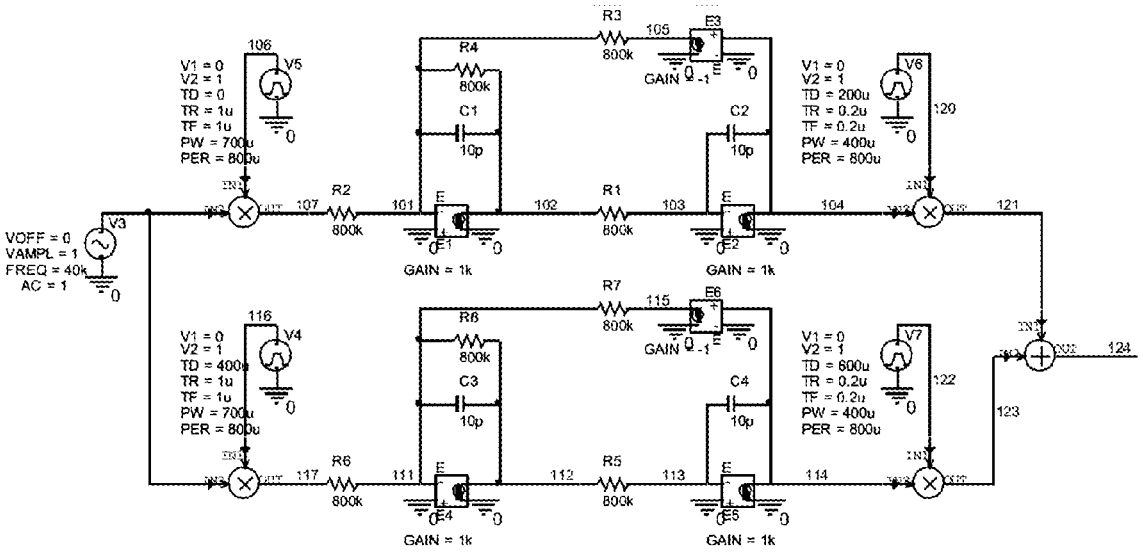
FIG. 4A depicts one simple behavioral model for a two-analog-computer configuration for the improved analog-computing-system calibration schema.
Figure 4B:
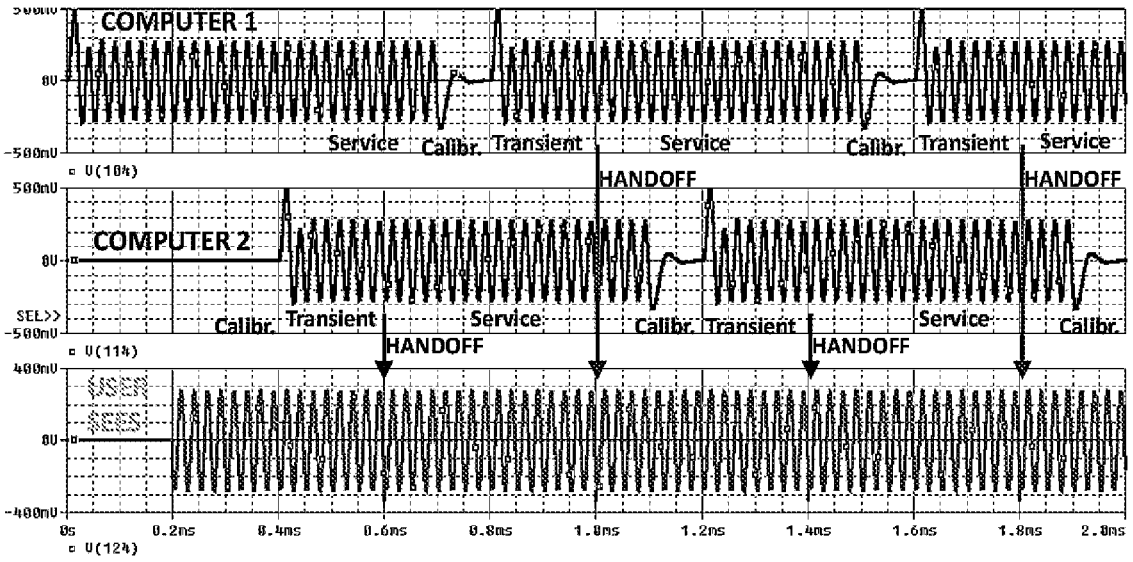
FIG. 4B depicts a graphical representation of the analog-computing system output in terms of the alternating service and calibration modes of operation for Computer-1 and Computer-2, with a plot for each analog-computer and a plot for the overall system output that an external user sees. It should be noted that the transient region as one analog computer moves from the calibration mode to the service mode overlaps the service mode of the other analog computer so as to ensure a continuous and stable overall system output.

The key in making this scheme work is the relative timing of the input and output multiplexers at the analog computers. FIGS. 4A though 4D describe one embodiment of an example of this technique, with FIG. 4A showing a simple behavioral model for a two-analog-computer configuration. FIG. 4B depicts a graphical representation of the analog-computing system output in terms of the alternating service and calibration modes of operation for Computer-1 and Computer-2, with a plot for each analog-computer and a plot for the overall system output that a user sees. It should be noted that the transient region as one analog computer moves from the calibration mode to the service mode overlaps the service mode of the other analog computer so as to ensure a continuous and stable overall system output. From an external point of view, a system user only sees one calibration cycle (as opposed to hundreds or more) and the analog-computing system never has to be taken down for re-calibration. This technique makes the difference between interrupted service and continuous service.

As was mentioned above in the discussion relating to FIG. 2C, the two computers being linked might be in two separate chips as shown in FIG. 2C. But they might just as well be distinct computers (perhaps termed "sub-computers") within a single chip, created by suitable allocation of circuit elements to the two sub-computers and by suitable configuration of the analog switching fabric. In the latter approach, the switching of inputs to the two computers, and the switching of outputs from the two computers, according to the teachings of the invention, would likely be accomplished by real-time manipulation of the analog switching fabric just mentioned.

[2] Timing Constraints

Since one analog computer needs to be calibrated and since it is necessary to wait for its transients to die out, while the second analog computer is computing:

$$T_{compute} > T_{calibrate} + T_{transients}$$

Where:

$T_{compute}$ is the compute time period;

$T_{calibrate}$ is the calibration time period; and $T_{transients}$ is the time period for system transients to dissipate.

[3] Application to Amplitude Scaling in Analog Computers

To eliminate the back-in-service transient, an embodiment an amplitude-scaling technique for filters can be used, in which the states (that is, capacitor voltages) are held while scaling changes are made, while transients are avoided. See, e.g., U.S. Pat. No. 5,541,600 to E. Blumenkrantz et al., for "Signal processing circuit including a variable gain input stage." The teachings of U.S. Pat. No. 5,541,600 are incorporated by reference.

Figure 4C:
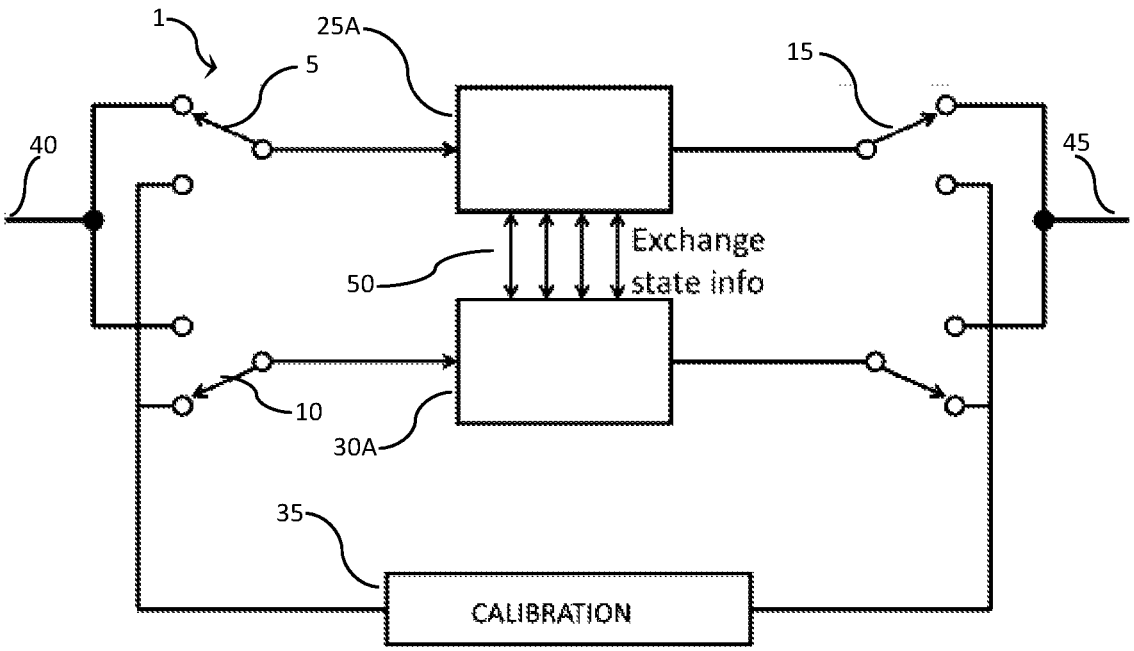
FIG. 4C depicts one embodiment of a simplified example of a two analog computer approach, with an "input" and an "output", input switches, output switches, a calibration module, and state-information-exchange circuitry.
Figure 4D:
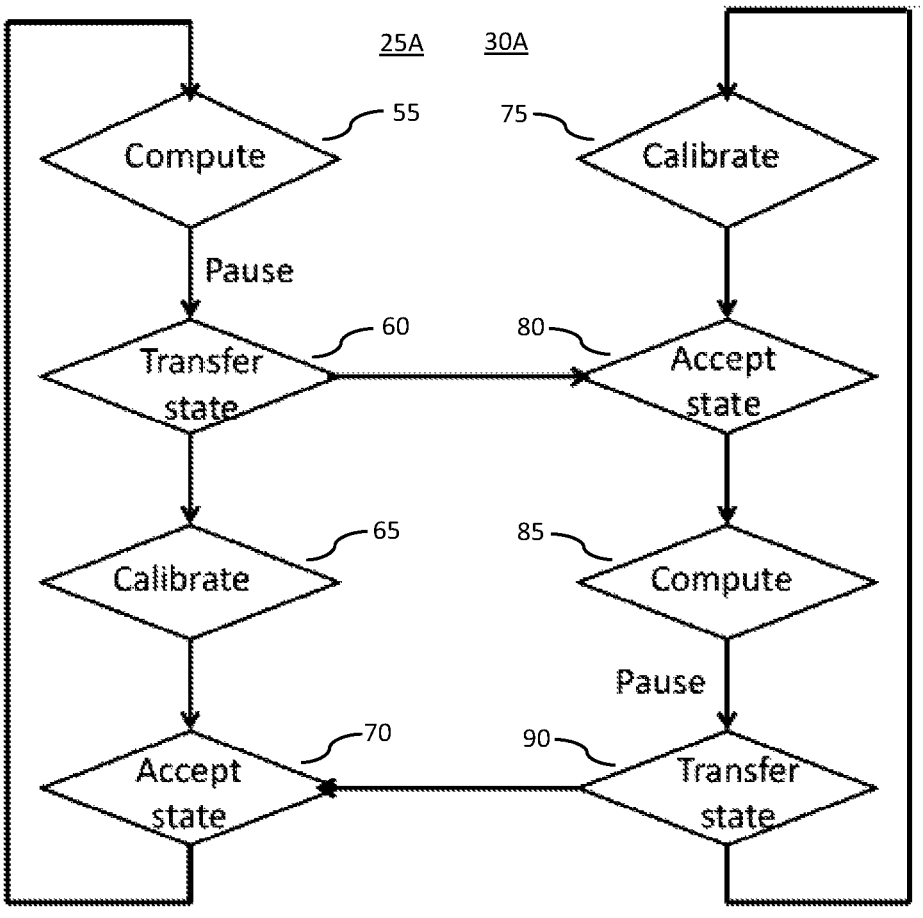
FIG. 4D depicts one embodiment of a simplified process block diagram of the system-calibration process of a computing system with two analog computers.

This amplitude-scaling technique can be extended to the case of two (or more) analog computers, in which the states (that is, the integrator outputs) are passed from one analog computer to the other. If the pause times can be eliminated or minimized/tolerated in a given application, then this state-information-exchange schema should be considered. FIG. 4C depicts one behavioral model of a system with two analog computers, with an "input" 40 and an "output" 45 (once again, these values can be vectors), input switches 5, 10, output switches 15, 20, first and second computers 25A, 30A, calibration module 35, and state-information-exchange circuitry 50. FIG. 4D depicts a simplified process block diagram of a system with two analog computers according to such a behavioral model: Computer 1 25A undergoes the processes of Compute 55, Pause/Transfer state 60 (sending state data to Computer 2 30A), Calibrate 65, and Accept state 70 (receiving state data from Computer 2 30A); and Computer 2 30A undergoes the parallel processes (with respect to Computer 1 25A) of Calibrate 75, Accept state 80 (receiving state data from Computer 1 25A), Compute 85, and Pause/Transfer state 90 (sending state data to Computer 1 30A). These processes repeat throughout system operation.

Figures 5A, 5B:
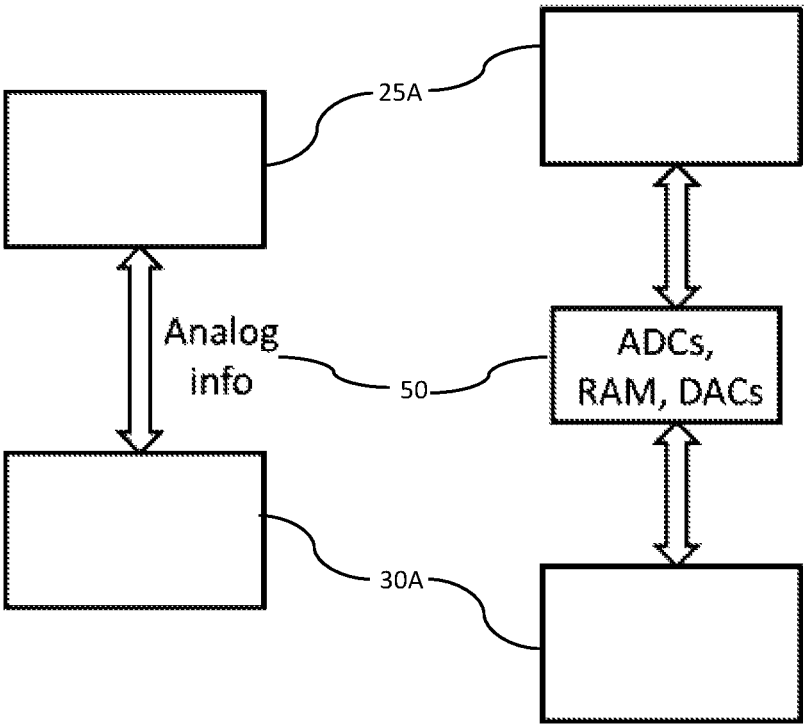
FIGS. 5A and 5B each depict embodiments of two simplified diagrams on how to accomplish the transfer of state information between two analog computers in an improved analog-computing system, via a data-transfer apparatus.

FIGS. 5A and 5B each depict embodiments of two simplified diagrams on how to accomplish the transfer of state information between Computer 1 25A and Computer 2 30A, via a data-transfer apparatus 50. In a variation, as shown in FIG. 5A, the state-information transfer occurs via a direct transfer of analog data 50. In an alternate variation, as shown in FIG. 5B, the state-information transfer occurs via the use of intermediary onboard analog-data processing components 50, such as analog-to-digital converters (ADCs), random-access memory (RAM), and digital-to-analog converters (DACs).

In additional embodiments, the approaches described above can be used for amplitude scaling without interruption. In fact, amplitude scaling can be considered as part of the calibration process. Some examples of circuit configurations that can be exploited to combine such system-input filtering with the calibration schemas presented above are disclosed in U.S. Pat. No. 7,274,760 to Palaskas et al., for "Circuit and method for dynamically modifiable signal processor," and U.S. Pat. No. 7,274,760 is hereby incorporated by reference.

It may thus be helpful to review what has been described. The approach according to the invention is to provide first and second analog computers, each having respective inputs and outputs. At any given moment one computer or the other can be in production service, serving whatever the user goals are for the production system. This might be assisting in management of an electric vehicle or an electrical energy storage system but could be any environment in which analog computation is helpful. Typical environments where such computation is helpful are environments in which it is a goal to provide solutions or at least near solutions to systems of non-linear differential equations. The solution itself may be put to use directly, for example to determine some concrete result in management of some physical system. Or some near solution may be developed which is in turn provided to a digital system which takes the near solution as a starting point and arrives at a digitally computed result which is put to use directly to determine some concrete result in management of some physical system.

According to the invention, while one of the analog computers is in production service, its inputs are connected to the production inputs of the system and its outputs are connected to the production outputs of the system. This is typically carried out by means of an analog crosspoint switching fabric providing analog switching capability to each of the two analog computers, to calibration equipment, and to the production inputs and outputs.

While one of the analog computers is thus in production service, it is thus possible to carry out calibration of the other of the analog computers. Its inputs are connected to calibration inputs of the calibration equipment, and its outputs are connected to calibration output-receiving signal lines of the calibration equipment. Calibration is then carried out.

Depending upon the analog computation elements involved, and their technology, the calibration might take milliseconds or seconds, but for some technologies the calibration might take on the order of minutes.

Because the production function is being supported by the other analog computer (the computer that is not being calibrated), it is not a problem if the calibration process takes seconds or even minutes.

When the calibration process has finished, then a handover takes place. The computer that just finished calibration gets its inputs disconnected from the calibration inputs and connected to the production inputs. This will typically be a "break before make" type of switching.

After a while this computer settles and its outputs can likely be trusted. Upon occurrence of a predetermined condition, the outputs of this computer get connected to the production outputs and the outputs of the other computer (that had previously been in production) get disconnected from the production outputs. This will typically be a "make before break" type of switching.

The alert reader will appreciate that in the figures, the many inputs to a particular analog computer are portrayed symbolically as a single signal line, the many outputs are portrayed symbolically as a single signal line, and so on, for simplicity of portrayal in the figures. The analog signal switching which is actually many analog switches is portrayed symbolically as a single-pole double-throw switch, again for simplicity of portrayal in the figures. It is nonetheless appreciated that in actual implementation there are a multiplicity of signals arriving at the inputs and at the outputs of any given analog computer or calibration apparatus, or at the inputs or at the outputs of the physical system for which the production apparatus is providing analog computation.

A predetermined condition is chosen by the system designer to determine when to connect the outputs of the just-calibrated analog computer to the production outputs. A simple predetermined condition which may be employed is simply to allow the passage of a predetermined time interval, based upon accumulated experience as to the settling time of the various analog computational elements, or based upon a modeled settling time thereof.

A slightly more sophisticated predetermined condition which may be employed is to provide a threshold device (by which is meant a system of threshold devices, one for each pair of signals) to compare output signals from the two analog computers, meaning the computer that has been in production and the computer that just finished calibration. And the threshold may be employed to arrive at a conclusion that settling has happened in the computer that just finished calibration. Given that settling has happened, then the condition is deemed satisfied, and that computer has its outputs connected to the production outputs. In plain language, that computer is put into production service.

The duty cycle for production and calibration is selected taking into account accumulated experience as to the likely pace and magnitude of drift in the analog computer computational elements, or a modeled drift. The goal of course is to carry out calibration often enough to minimize the accumulated drift at any particular time prior to the next calibration having taken place.

The alert reader will also appreciate one other possible benefit to provision of the threshold device mentioned above, namely that it can also be employed during production service to monitor drift in the analog computer that has had the longest time having passed since calibration. This monitoring can be helpful in any of several ways. First, it permits further accumulated experience as to drift, which permits more informed decisions in future as to generally speaking how often recalibration is likely to be needed. Second it could permit individual real-time decisions as to when to carry out calibration in that analog computer. Third, in the event of widely divergent outputs from the two analog computers, this could provide a warning that one of the analog computers may have suffered a failure of some analog computational element.

The threshold device is of course a two-input device. The alert reader will also appreciate that in production environments where high reliability is needed, it would be possible to provide (for example) three analog computers and a three-input voter containing suitable threshold devices and voting logic. In the event of one analog computer running amok, for example due to catastrophic failure of some analog computational element, the voter could work out which two analog computers to keep in production service and which one analog computer to disconnect from production service. The high-reliability system just mentioned can also carry out the calibration processes mentioned earlier, in which one computer provides production computations (or two computers provide production computations) while another computer is undergoing recalibration.

What is described, then, is a method for use with first and second physical analog computers in a production system having production inputs and outputs, each of the analog computers having respective inputs and outputs, and for use with a calibration apparatus having calibration signals to be provided for inputs and receiving signals from outputs, the method comprising the steps of:

connecting the inputs of the first analog computer to the production inputs, and connecting the outputs of the first analog computer to the production outputs, thereby putting the first analog computer into production service;

connecting the inputs of the second analog computer to the calibration input signals, and connecting the outputs of the second analog computer to the calibration output signals, thereby putting the second analog computer into calibration mode;

carrying out calibration of the second analog computer;

disconnecting the inputs of the second analog computer from the calibration inputs and disconnecting the outputs of the second analog computer from the calibration outputs, thereby taking the second analog computer out of calibration mode;

connecting the inputs of the second analog computer to the production inputs;

upon fulfillment of a predetermined condition, connecting the outputs of the second analog computer to the production outputs, thereby putting the second analog computer into production service;

disconnecting the outputs of the first analog computer from the production outputs, thereby taking the first analog computer out of production service;

disconnecting the inputs of the first analog computer from the production inputs;

and repeating this process over and over again. So for example at a subsequent time, the method involves once again connecting the inputs of the first analog computer to the calibration input signals, and connecting the outputs of the first analog computer to the calibration output signals, thereby putting the first analog computer into calibration mode;

carrying out calibration of the first analog computer;

disconnecting the inputs of the first analog computer from the calibration inputs and disconnecting the outputs of the first analog computer from the calibration outputs, thereby taking the first analog computer out of calibration mode;

connecting the inputs of the first analog computer to the production inputs;

upon fulfillment of the predetermined condition, connecting the outputs of the first analog computer to the production outputs, thereby putting the first analog computer into production service;

disconnecting the outputs of the second analog computer from the production outputs, thereby taking the second analog computer out of production service;

disconnecting the inputs of the second analog computer from the production inputs;

connecting the inputs of the second analog computer to the calibration input signals, and connecting the outputs of the second analog computer to the calibration output signals, thereby putting the second analog computer into calibration mode;

carrying out calibration of the second analog computer;

disconnecting the inputs of the second analog computer from the calibration inputs and disconnecting the outputs of the second analog computer from the calibration outputs, thereby taking the second analog computer out of calibration mode;

connecting the inputs of the second analog computer to the production inputs;

upon fulfillment of a predetermined condition, connecting the outputs of the second analog computer to the production outputs, thereby putting the second analog computer into production service;

disconnecting the outputs of the first analog computer from the production outputs, thereby taking the first analog computer out of production service;

disconnecting the inputs of the first analog computer from the production inputs;

connecting the inputs of the first analog computer to the calibration input signals, and connecting the outputs of the first analog computer to the calibration output signals, thereby putting the first analog computer into calibration mode;

carrying out calibration of the first analog computer;

disconnecting the inputs of the first analog computer from the calibration inputs and disconnecting the outputs of the first analog computer from the calibration outputs, thereby taking the first analog computer out of calibration mode;

connecting the inputs of the first analog computer to the production inputs;

upon fulfillment of the predetermined condition, connecting the outputs of the first analog computer to the production outputs, thereby putting the first analog computer into production service;

disconnecting the outputs of the second analog computer from the production outputs, thereby taking the second analog computer out of production service;

disconnecting the inputs of the second analog computer from the production inputs;

connecting the inputs of the second analog computer to the calibration input signals, and connecting the outputs of the second analog computer to the calibration output signals, thereby putting the second analog computer into calibration mode; and carrying out calibration of the second analog computer.

As discussed earlier the predetermined condition for switching a just-calibrated analog computer back into production service may simply be the passage of a predetermined interval of time. Alternatively, the predetermined condition may be a determination that outputs of the just-calibrated computer have settled, measured by a threshold device.

The switching of inputs of an analog computer from calibration inputs to production inputs may be "break before make". The switching of outputs of an analog computer that was just calibrated, to the production outputs, and the switching of the other analog computer's outputs away from the production outputs, may be "make before break".

It will be reviewed that each analog computer will comprise several integrators, each integrator having an internal state defining the output thereof. Before an analog computer is placed into calibration mode, we may store the internal states of the integrators thereof. We then may transfer the stored internal state of integrators thereof to the corresponding integrators of the other analog computer having just been taken out of calibration mode.

A third physical analog computer may be provided in the production system, the third analog computer having respective inputs and outputs. What then can take place is that the inputs of the third analog computer are connected to the production inputs. Then, at a time when all three of the analog computers are in production service, the outputs of the three analog computers may be connected to respective inputs of the threshold device, and, in the event of an excursion of a production output of any one of the analog computers relative to the production outputs of the other two analog computers in excess of a predetermined threshold, the event may be annunciated by means of a communication external to the system.

We thus may have apparatus comprising first and second physical analog computers in a production system having production inputs and outputs, each of the analog computers having respective inputs and outputs, the apparatus further comprising a calibration apparatus having calibration signals to be provided for inputs and receiving signals from outputs, the apparatus further comprising a switching fabric disposed to selectively connect the inputs of the first analog computer to the production inputs or to the calibration inputs, and disposed to selectively connect the outputs of the first analog computer to the production outputs or to the calibration outputs, the switching fabric further disposed to selectively connect the inputs of the second analog computer to the production inputs or to the calibration inputs, and disposed to selectively connect the outputs of the second analog computer to the production outputs or to the calibration outputs.

The various embodiments and variations thereof described herein, including the descriptions in any appended Claims and/or illustrated in the accompanying Figures, are merely exemplary and are not meant to limit the scope of the inventive disclosure. It should be appreciated that numerous variations of the invention have been contemplated as would be obvious to alert readers with the benefit of this disclosure.

Hence, alert readers will have no difficulty devising myriad obvious variations and improvements to the invention, all of which are intended to be encompassed within the scope of the Description, Figures, and Claims herein.

The invention claimed is:

1. A method for use with first and second physical analog computers in a production system having production inputs and outputs, each of the analog computers having respective inputs and outputs, and for use with a calibration apparatus having calibration signals to be provided for inputs and receiving signals from outputs, wherein each analog computer comprises at least two integrators, each integrator having an internal state defining the output thereof, the at least two integrators of each analog computer corresponding to the at least two integrators of the other of the analog computers, the method comprising the steps of:

connecting the inputs of the first analog computer to the production inputs, and connecting the outputs of the first analog computer to the production outputs, thereby putting the first analog computer into production service;

connecting the inputs of the second analog computer to the calibration input signals, and connecting the outputs of the second analog computer to the calibration output signals, thereby putting the second analog computer into calibration mode;

carrying out calibration of the second analog computer;

disconnecting the inputs of the second analog computer from the calibration inputs and disconnecting the outputs of the second analog computer from the calibration outputs, thereby taking the second analog computer out of calibration mode;

connecting the inputs of the second analog computer to the production inputs;

upon fulfillment of a predetermined condition, connecting the outputs of the second analog computer to the production outputs, thereby putting the second analog computer into production service;

disconnecting the outputs of the first analog computer from the production outputs, thereby taking the first analog computer out of production service;

disconnecting the inputs of the first analog computer from the production inputs;

connecting the inputs of the first analog computer to the calibration input signals, and connecting the outputs of the first analog computer to the calibration output signals, thereby putting the first analog computer into calibration mode;

carrying out calibration of the first analog computer;

disconnecting the inputs of the first analog computer from the calibration inputs and disconnecting the outputs of the first analog computer from the calibration outputs, thereby taking the first analog computer out of calibration mode;

connecting the inputs of the first analog computer to the production inputs;

upon fulfillment of the predetermined condition, connecting the outputs of the first analog computer to the production outputs, thereby putting the first analog computer into production service;

disconnecting the outputs of the second analog computer from the production outputs, thereby taking the second analog computer out of production service;

disconnecting the inputs of the second analog computer from the production inputs;

connecting the inputs of the second analog computer to the calibration input signals, and connecting the outputs of the second analog computer to the calibration output signals, thereby putting the second analog computer into calibration mode;

carrying out calibration of the second analog computer;

disconnecting the inputs of the second analog computer from the calibration inputs and disconnecting the outputs of the second analog computer from the calibration outputs, thereby taking the second analog computer out of calibration mode;

connecting the inputs of the second analog computer to the production inputs;

upon fulfillment of a predetermined condition, connecting the outputs of the second analog computer to the production outputs, thereby putting the second analog computer into production service;

disconnecting the outputs of the first analog computer from the production outputs, thereby taking the first analog computer out of production service;

disconnecting the inputs of the first analog computer from the production inputs;

connecting the inputs of the first analog computer to the calibration input signals, and connecting the outputs of the first analog computer to the calibration output signals, thereby putting the first analog computer into calibration mode;

carrying out calibration of the first analog computer;

disconnecting the inputs of the first analog computer from the calibration inputs and disconnecting the outputs of the first analog computer from the calibration outputs, thereby taking the first analog computer out of calibration mode;

connecting the inputs of the first analog computer to the production inputs;

upon fulfillment of the predetermined condition, connecting the outputs of the first analog computer to the production outputs, thereby putting the first analog computer into production service;

disconnecting the outputs of the second analog computer from the production outputs, thereby taking the second analog computer out of production service;

disconnecting the inputs of the second analog computer from the production inputs;

connecting the inputs of the second analog computer to the calibration input signals, and connecting the outputs of the second analog computer to the calibration output signals, thereby putting the second analog computer into calibration mode; and carrying out calibration of the second analog computer;

the method further comprising the step, performed before each analog computer is placed into calibration mode, of storing the internal states of the integrators thereof, and thereafter transferring the stored internal state of integrators thereof to the corresponding integrators of the other analog computer having just been taken out of calibration mode.

2. The method of claim 1 wherein the predetermined condition is the passage of a predetermined interval of time.

3. The method of claim 1 wherein the predetermined condition is a determination that outputs of the just-calibrated computer have settled, measured by a threshold device.

4. The method of claim 1 wherein the switching of inputs of an analog computer from calibration inputs to production inputs is "break before make".

5. The method of claim 1 wherein the switching of outputs of an analog computer that was just calibrated, to the production outputs, and the switching of the other analog computer's outputs away from the production outputs, is "make before break".

6. A method for use with first and second physical analog computers in a production system having production inputs and outputs, each of the analog computers having respective inputs and outputs, and for use with a calibration apparatus having calibration signals to be provided for inputs and receiving signals from outputs, the method carried out with respect to a third physical analog computer in the production system, the third analog computer having respective inputs and outputs, and carried out with respect to a threshold device, the threshold device having three inputs, the method comprising the steps of:

connecting the inputs of the first analog computer to the production inputs, and connecting the outputs of the first analog computer to the production outputs, thereby putting the first analog computer into production service;

connecting the inputs of the second analog computer to the calibration input signals, and connecting the outputs of the second analog computer to the calibration output signals, thereby putting the second analog computer into calibration mode;

carrying out calibration of the second analog computer;

disconnecting the inputs of the second analog computer from the calibration inputs and disconnecting the outputs of the second analog computer from the calibration outputs, thereby taking the second analog computer out of calibration mode;

connecting the inputs of the second analog computer to the production inputs;

upon fulfillment of a predetermined condition, connecting the outputs of the second analog computer to the production outputs, thereby putting the second analog computer into production service;

disconnecting the outputs of the first analog computer from the production outputs, thereby taking the first analog computer out of production service;

disconnecting the inputs of the first analog computer from the production inputs;

connecting the inputs of the first analog computer to the calibration input signals, and connecting the outputs of the first analog computer to the calibration output signals, thereby putting the first analog computer into calibration mode;

carrying out calibration of the first analog computer;

disconnecting the inputs of the first analog computer from the calibration inputs and disconnecting the outputs of the first analog computer from the calibration outputs, thereby taking the first analog computer out of calibration mode;

connecting the inputs of the first analog computer to the production inputs;

upon fulfillment of the predetermined condition, connecting the outputs of the first analog computer to the production outputs, thereby putting the first analog computer into production service;

disconnecting the outputs of the second analog computer from the production outputs, thereby taking the second analog computer out of production service;

disconnecting the inputs of the second analog computer from the production inputs;

connecting the inputs of the second analog computer to the calibration input signals, and connecting the outputs of the second analog computer to the calibration output signals, thereby putting the second analog computer into calibration mode;

carrying out calibration of the second analog computer;

disconnecting the inputs of the second analog computer from the calibration inputs and disconnecting the outputs of the second analog computer from the calibration outputs, thereby taking the second analog computer out of calibration mode;

connecting the inputs of the second analog computer to the production inputs;

upon fulfillment of a predetermined condition, connecting the outputs of the second analog computer to the production outputs, thereby putting the second analog computer into production service;

disconnecting the outputs of the first analog computer from the production outputs, thereby taking the first analog computer out of production service;

disconnecting the inputs of the first analog computer from the production inputs;

connecting the inputs of the first analog computer to the calibration input signals, and connecting the outputs of the first analog computer to the calibration output signals, thereby putting the first analog computer into calibration mode;

carrying out calibration of the first analog computer;

disconnecting the inputs of the first analog computer from the calibration inputs and disconnecting the outputs of the first analog computer from the calibration outputs, thereby taking the first analog computer out of calibration mode;

connecting the inputs of the first analog computer to the production inputs;

upon fulfillment of the predetermined condition, connecting the outputs of the first analog computer to the production outputs, thereby putting the first analog computer into production service;

disconnecting the outputs of the second analog computer from the production outputs, thereby taking the second analog computer out of production service;

disconnecting the inputs of the second analog computer from the production inputs;

connecting the inputs of the second analog computer to the calibration input signals, and connecting the outputs of the second analog computer to the calibration output signals, thereby putting the second analog computer into calibration mode; and carrying out calibration of the second analog computer;

the method further comprising the steps of:

connecting the inputs of the third analog computer to the production inputs;

at a time when all three of the analog computers are in production service, connecting the outputs of the three analog computers to respective inputs of the threshold device, and, in the event of an excursion of a production output of any one of the analog computers relative to the production outputs of the other two analog computers in excess of a predetermined threshold, annunciating the event by means of a communication external to the system.

7. The method of claim 6 wherein the predetermined condition is the passage of a predetermined interval of time.

8. The method of claim 6 wherein the predetermined condition is a determination that outputs of the just-calibrated computer have settled, measured by a threshold device.

9. The method of claim 6 wherein the switching of inputs of an analog computer from calibration inputs to production inputs is "break before make".

10. The method of claim 6 wherein the switching of outputs of an analog computer that was just calibrated, to the production outputs, and the switching of the other analog computer's outputs away from the production outputs, is "make before break".

11. Apparatus comprising first and second physical analog computers in a production system having production inputs and outputs, each of the analog computers having respective inputs and outputs, the apparatus further comprising a calibration apparatus having calibration signals to be provided for inputs and receiving signals from outputs, the apparatus further comprising a switching fabric disposed to selectively connect the inputs of the first analog computer to the production inputs or to the calibration inputs, and disposed to selectively connect the outputs of the first analog computer to the production outputs or to the calibration outputs, the switching fabric further disposed to selectively connect the inputs of the second analog computer to the production inputs or to the calibration inputs, and disposed to selectively connect the outputs of the second analog computer to the production outputs or to the calibration outputs, wherein each analog computer comprises at least two integrators, each integrator having an internal state defining the output thereof, the at least two integrators of each analog computer corresponding to the at least two integrators of the other of the analog computers, the apparatus further comprising transfer means disposed at predetermined times to store the internal states of the integrators of any one of the analog computers, and to transfer stored internal state of said integrators to the corresponding integrators of the other analog computer.

12. The apparatus of claim 11 wherein the switching fabric is further characterized in that the switching of inputs of to an analog computer is "break before make".

13. The apparatus of claim 11 wherein the switching fabric is further characterized in that the switching of outputs of the analog computers to production outputs is "make before break".

14. The apparatus of claim 11 wherein the predetermined time is a time when a first one of the analog computers has just been taken out of calibration mode, and a second one of the analog computers is about to be placed into calibration mode, the transfer being from the second analog computer to the first analog computer.

15. Apparatus comprising first and second physical analog computers in a production system having production inputs and outputs, each of the analog computers having respective inputs and outputs, the apparatus further comprising a calibration apparatus having calibration signals to be provided for inputs and receiving signals from outputs, the apparatus further comprising a switching fabric disposed to selectively connect the inputs of the first analog computer to the production inputs or to the calibration inputs, and disposed to selectively connect the outputs of the first analog computer to the production outputs or to the calibration outputs, the switching fabric further disposed to selectively connect the inputs of the second analog computer to the production inputs or to the calibration inputs, and disposed to selectively connect the outputs of the second analog computer to the production outputs or to the calibration outputs, further comprising a third analog computer in the production system, the third analog computer having respective inputs and outputs, the switching fabric further disposed to selectively connect the inputs of the third analog computer to the production inputs or to the calibration inputs, and disposed to selectively connect the outputs of the third analog computer to the production outputs or to the calibration outputs, the apparatus further comprising a threshold device disposed to annunciate an excursion of a production output of any one of the analog computers relative to the production outputs of the other two analog computers in excess of a predetermined threshold, the annunciation communicated external to the system.

16. The apparatus of claim 15 wherein the switching fabric is further characterized in that the switching of inputs of to an analog computer is "break before make".

17. The apparatus of claim 15 wherein the switching fabric is further characterized in that the switching of outputs of the analog computers to production outputs is "make before break".

* * * * *